US007229329B2

(12) United States Patent
Yamashita et al.

(10) Patent No.: US 7,229,329 B2
(45) Date of Patent: Jun. 12, 2007

(54) FEMALE TERMINAL FITTING

(75) Inventors: Kazunori Yamashita, Yokkaichi (JP); Hiroyuki Oka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/328,969

(22) Filed: Jan. 9, 2006

(65) Prior Publication Data

US 2006/0172618 A1 Aug. 3, 2006

(30) Foreign Application Priority Data

Jan. 28, 2005 (JP) ..... 2005-021914

(51) Int. Cl.
*H01R 11/22* (2006.01)

(52) U.S. Cl. ..... 439/852; 439/595

(58) Field of Classification Search ..... 439/852, 439/851, 595

See application file for complete search history.

(56) References Cited

U.S. PATENT DOCUMENTS 6,019,646 A * 2/2000 Okamura et al. ..... 439/852

6,736,684 B2 * 5/2004 Ishiyama ..... 439/852

FOREIGN PATENT DOCUMENTS

JP 2003-346958 12/2003

* cited by examiner

*Primary Examiner*—Truc Nguyen
(74) *Attorney, Agent, or Firm*—Gerald E. Hespos; Anthony J. Casella

(57) ABSTRACT

A female terminal fitting has a rectangular tubular body (12) with opposed first and second walls (16, 17) and an insertion opening (15) for receiving a tab (11). An elastic contact piece (21) is inside the body (12) and extends obliquely from a support (27) on the second wall (17) of the body (12) towards both the first wall (16) and the insertion opening (15). The elastic contact piece (21) then bends back towards the second wall (17) to define an apex (23). A projection (30) projects toward the first wall (16) from a location on the elastic contact piece (21) between the support (27) and the apex (23). The elastic contact piece (21) deforms flexibly about the support (27) when the tab (11) is inserted into the body (12), thus sandwiching the tab (11) between a contact (31) of the projection (30) and the first wall (16).

8 Claims, 9 Drawing Sheets

FEMALE TERMINAL FITTING

BACKGROUND OF THE INVENTION

1. Field of the Invention

The invention relates to a female terminal fitting.

2. Description of the Related Art

Japanese Patent Application Laid-Open No. 2003-346958 and FIG. 9 herein disclose a female terminal fitting. With reference to FIG. 9, the female terminal fitting is configured so that the tab 2 of a mating male terminal fitting can be inserted into a tab insertion opening 3 on the front surface a square pillar-shaped body 4 of the female terminal fitting. A resiliently deformable elastic contact 5 is disposed inside the body 4. More particularly, the contact 5 is folded from the rear end of a ceiling wall 6 of the body 4 and extends obliquely forward to a bent apex 7. The contact 5 then extends through a curve 8 and returns in a rearward direction back into contact with the ceiling wall 6.

A contact projection 5A projects from the elastic contact 5 towards a bottom wall 9 of the body part 4. The contact projection 5A has a contact 5B that aligns with the apex 7 in the longitudinal direction of the female terminal fitting and is below the apex 7 in the vertical direction of the female terminal fitting. The elastic contact 5 deforms resiliently about the rear end of the ceiling wall 6 when the tab 2 is inserted into the body 4. Thus, the tab 2 is sandwiched between the contact 5B of the contact projection 5A and the bottom wall 9 to connect the tab 2 electrically with the female terminal fitting.

A small gap is provided between the contact 5B of the contact projection 5A and the bottom wall 9. Thus, the force of inserting the tab 2 into the gap is liable to increase rapidly, and an operator may have trouble fitting two housings together.

The present invention has been completed in view of the above-described situation. Therefore it is an object of the present invention to reduce a resistance to insertion of a tab of a female terminal fitting.

SUMMARY OF THE INVENTION

The invention relates to a female terminal fitting with a body that has an insertion opening for receiving a tab of a mating male terminal fitting so that the tab can be inserted in and pulled from the insertion opening along an axial direction of the female terminal fitting. An elastic contact is disposed inside the body and has a support connected to one wall of the body. The elastic contact extends obliquely from the support towards the insertion opening and towards an opposed wall of the body. Additionally, the elastic contact is bent at an apex. A contact projection of the elastic contact projects towards the opposed wall and deforms flexibly about the support when the tab is inserted into the body for sandwiching the tab between a contact of the contact projection and the opposed wall.

The contact of the contact projection preferably is at a side of the support with respect to the apex in the longitudinal direction. Thus, the tab starts to engage the contact after the tab passes the apex and the tab increases the gap between the elastic contact piece and the opposed wall. Accordingly, a force for inserting the tab into the body will not increase rapidly after the tab engages the contact and hence the tab is inserted into the body more easily. Further the contact of the contact projection is to the side of the support with respect to the apex of the female terminal fitting. Therefore it is possible to secure a stable contact pressure between the contact and the tab after the tab is inserted into the body.

The contact projection preferably is sloped to incline from the contact towards the insertion opening. The slope starts at a bulge start point that aligns with the apex in the axial direction or is to the side of the support with respect to the apex in the axial direction. Therefore the gap between the contact and the opposed wall becomes large when the tab is inserted into the body, and resistance to the force for inserting the tab into the body is reduced significantly. Further it is possible to secure a stable contact pressure after the tab is inserted into the body part.

The contact of the contact projection preferably is aligned with the apex in a direction orthogonal to the axial direction or is to the side of the support with respect to the apex in the direction orthogonal to the axial direction. Therefore, resistance to the force for inserting the tab into the body is reduced significantly and secure a stable contact pressure is achieved after the tab is inserted into the body.

The front end of the tab preferably is tapered and the elastic contact piece contacts the tapered surface when the elastic contact piece starts to contact the tab. Therefore the elastic contact piece starts to perform a smooth flexing operation.

The operation of the sliding contact between the tab and the elastic contact piece starts from the state in which the contact projection contacts the tapered surface. Therefore the elastic contact piece performs a smooth flexing operation.

DETAILED DESCRIPTION OF THE PREFERRED EMBODIMENTS

Figure 1:
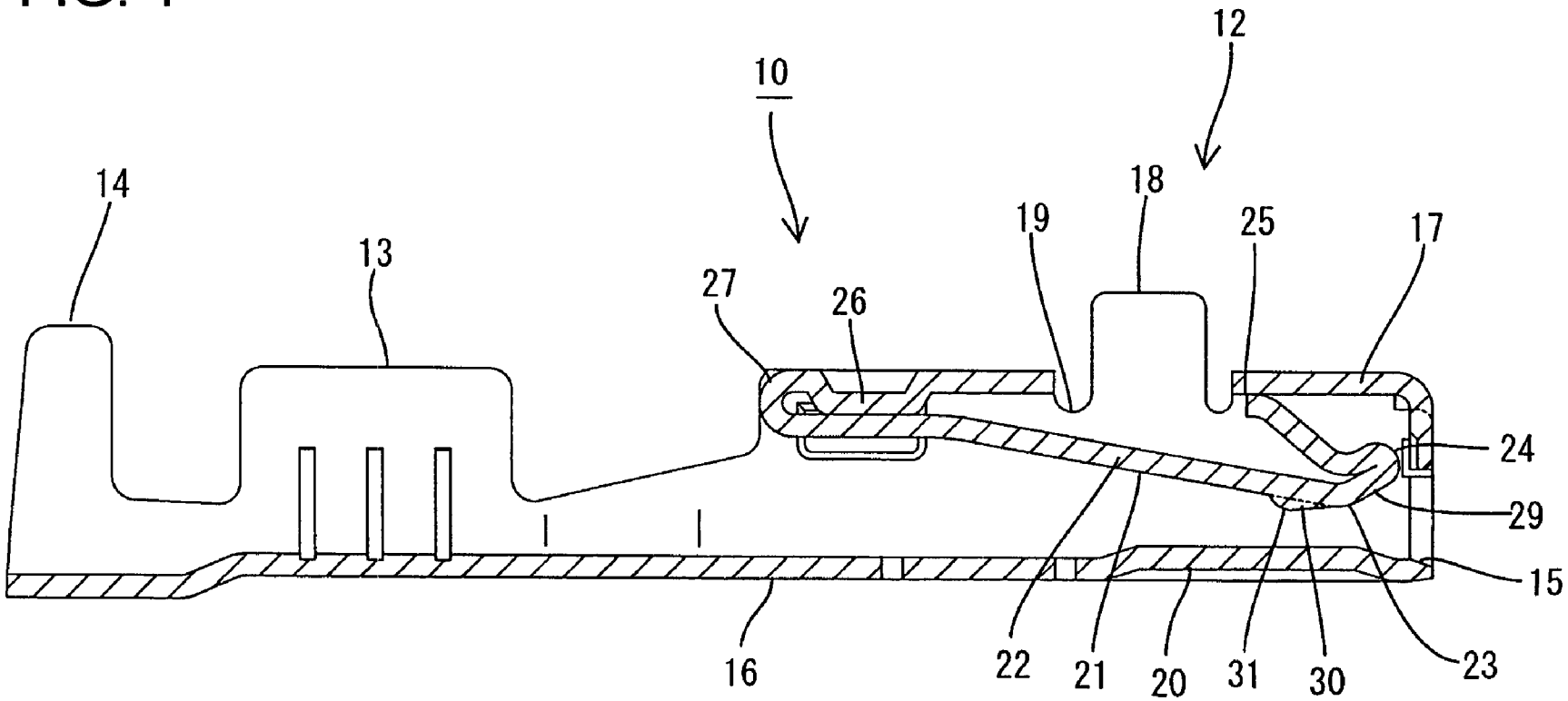
FIG. 1 is a sectional side elevation showing a female terminal fitting of one embodiment of the present invention.

A female terminal fitting according to the invention is identified by the numeral 10 in FIGS. 1 through 8 and is formed by bending a conductive metal plate. The female terminal fitting 10 is long and narrow in a longitudinal or axial direction.

A body 12 is formed at the front end of the female terminal fitting 10 and is configured for receiving a tab 11 of a mating male terminal fitting. A wire barrel 13 is disposed rearward from the body part 12 and is configured to be caulked to an end of a core wire of a covered electric wire (not shown). An insulation barrel 14 is rearward from the wire barrel 13 and is configured to be caulked to an insulated part of the wire. The wire barrel 13 and the insulation barrel 14 have a pair of crimping pieces 13A and a pair of crimping pieces 14A with respect to the axis of the female terminal fitting 10.

The body 12 is formed by bending the material widthwise in the shape of a square tube or pillar. An insertion opening 15 is formed on a front surface of the body 12 and is configured for receiving a male tab 11 of the male terminal fitting.

The body 12 has a bottom wall 16, left and right side walls 36 that extend up from left and right sides of the bottom wall 16, and a ceiling wall 17 that extends between the left and right side walls 36. The ceiling wall 17 is disposed forward from the wire barrel 13.

A stabilizer 18 projects up from a free end of one side wall 36 and is configured to fit in a guide groove formed in a cavity of a connector housing (not shown). The stabilizer 18 prevents the female terminal fitting 10 from being inserted into the c.

A locking hole 19 is formed on the ceiling wall 17 of the body 12 adjacent the stabilizer 18 (see FIG. 1). A resiliently deflectable lance (not shown) is provided inside the cavity of the connector housing and can be locked to the periphery of the locking hole 19.

The bottom wall 16 is struck to form a protrusion 20 with a flat top surface that extends longitudinally to allow it to slidably contact the tab 11 in a wide range and prevent the axis of the tab 11 from running out.

A flexibly deformable elastic contact piece 21 is folded in from a rear end of the ceiling wall 17. More specifically, the elastic contact piece 21 has an elastic beam 22 that extends obliquely down and forward towards the bottom wall 16 from the rear end of the ceiling wall 17. An apex 23 is disposed at a forward end of the elastic beam 22, and the elastic contact piece 21 is bent up and forward at the apex 23. A folded portion 24 is forward of the apex 23. The folded portion 24 has a lower section that extends obliquely up and forward from the apex 23 and an upper section that is folded back down over the lower section. The upper and lower sections of the folded portion 24 are folded in close contact. A sliding-contact portion 25 extends obliquely up and rearward from a rear end of the folded portion 24 and a rear end of the sliding-contact portion 25 is in contact with the ceiling wall 17.

A base 26 is formed at the rear of the ceiling wall 17 by striking the ceiling wall 17 down into the body part 12. A proximal portion 27 of the elastic beam 22 overlies the base 26. Two pieces 28 project sideways from the proximal portion 27 of the elastic beam 22 and fit in an engaging hole 37 on the corresponding side wall 36 for preventing excessive upward movement of the elastic contact piece 21.

The length of the elastic beam 22 in its longitudinal direction is set to ensure a smooth elastic operation of the elastic contact piece 21. The apex 23 is at the front end of the elastic beam 22 and nearest to the bottom wall 16. A front surface of the folded portion 24 is disposed to face the insertion opening 15 and functions as a tapered guide 29 for guiding the tab 11 to a normal insertion position.

Figure 2:
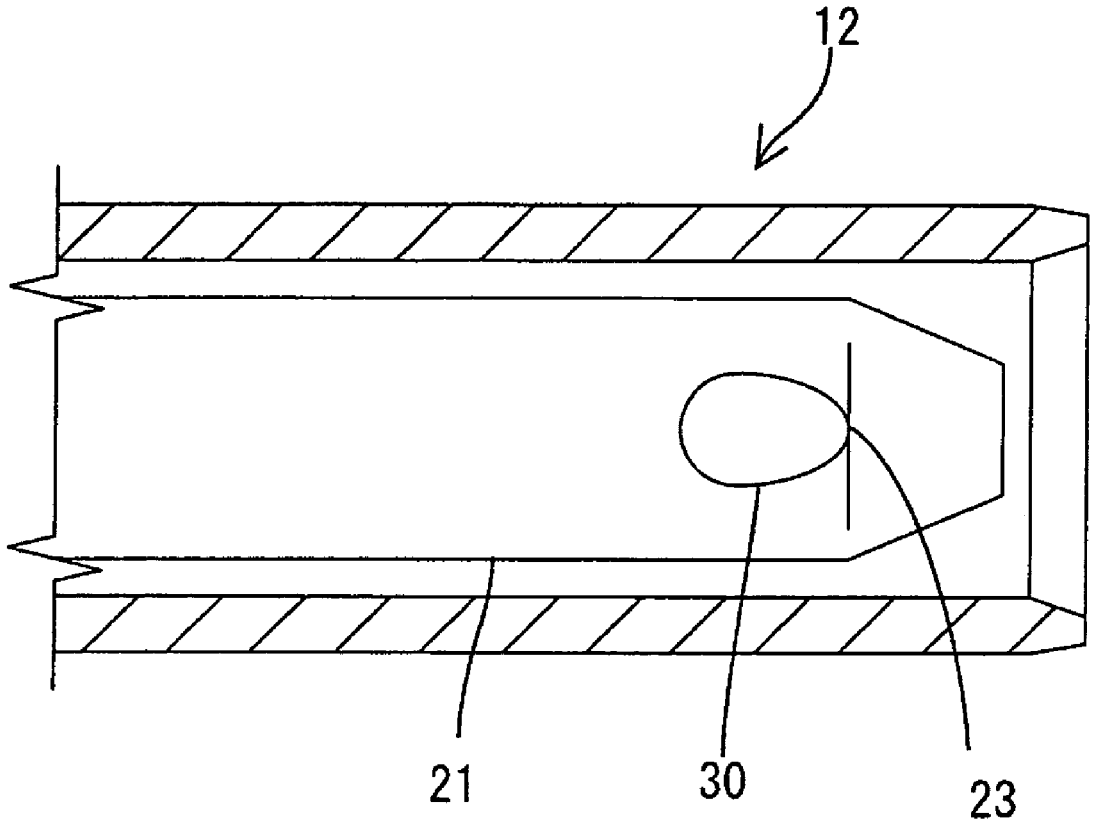
FIG. 2 is a cross-sectional view in which main portions are enlarged.
Figure 3:
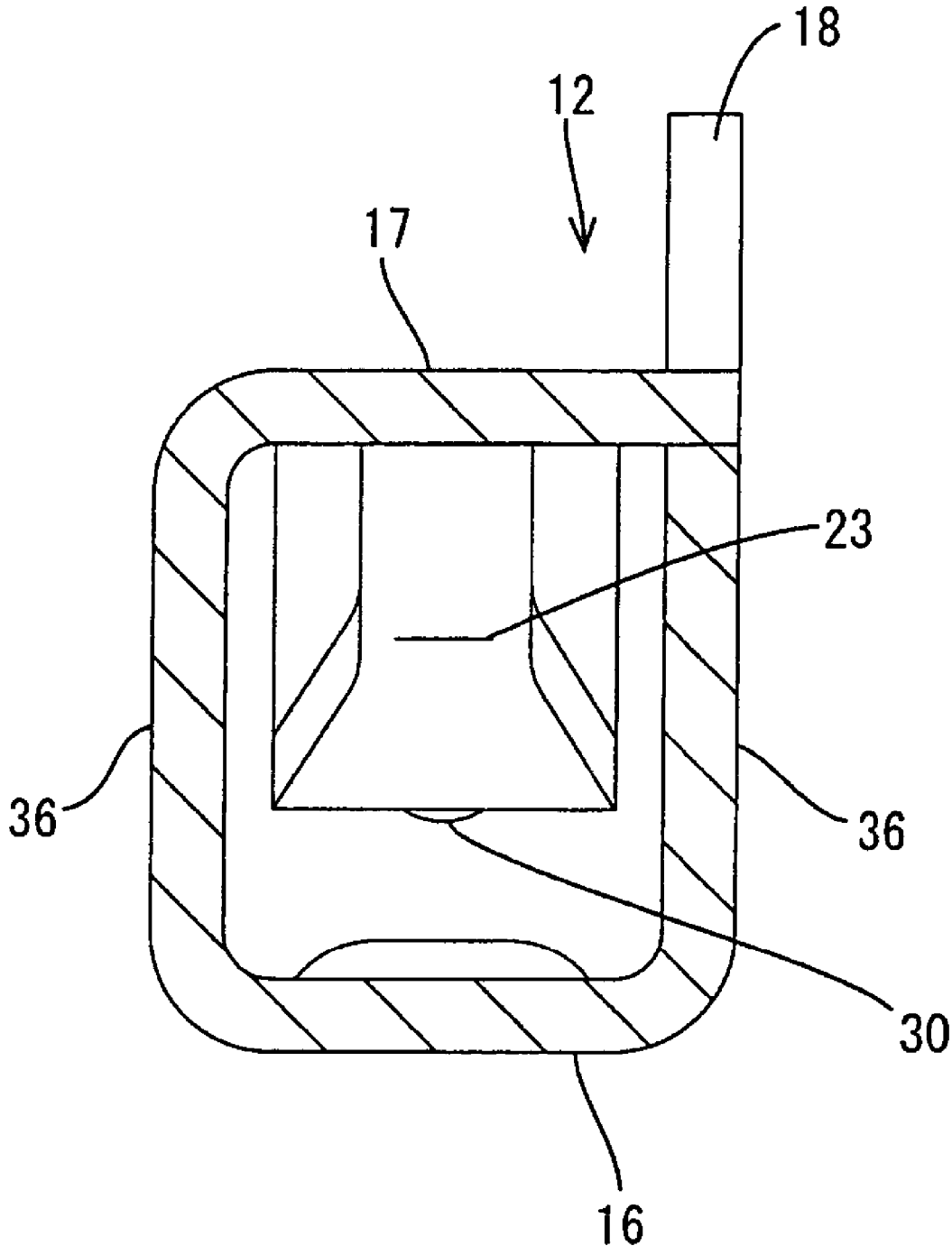
FIG. 3 is a vertical sectional view in which main portions are enlarged.
Figure 4:
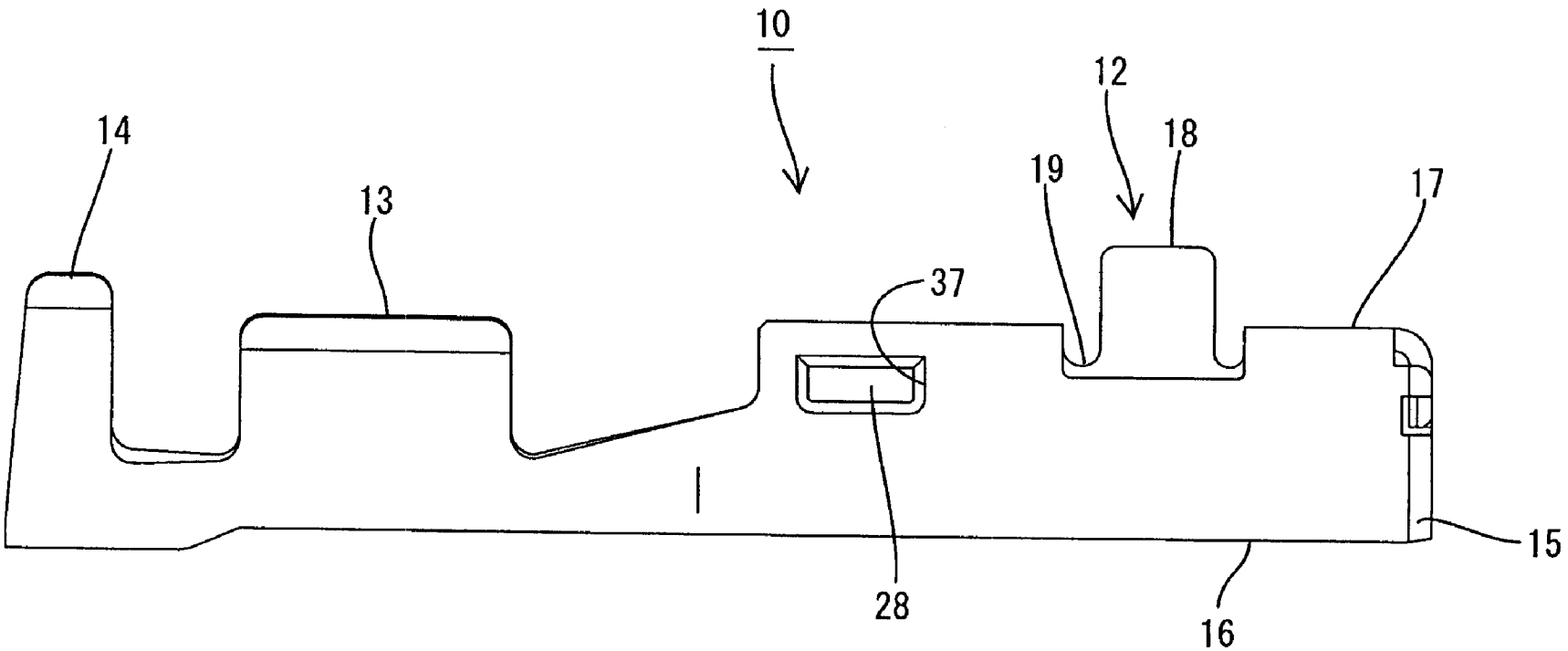
FIG. 4 is a side view showing the female terminal fitting.
Figure 5:
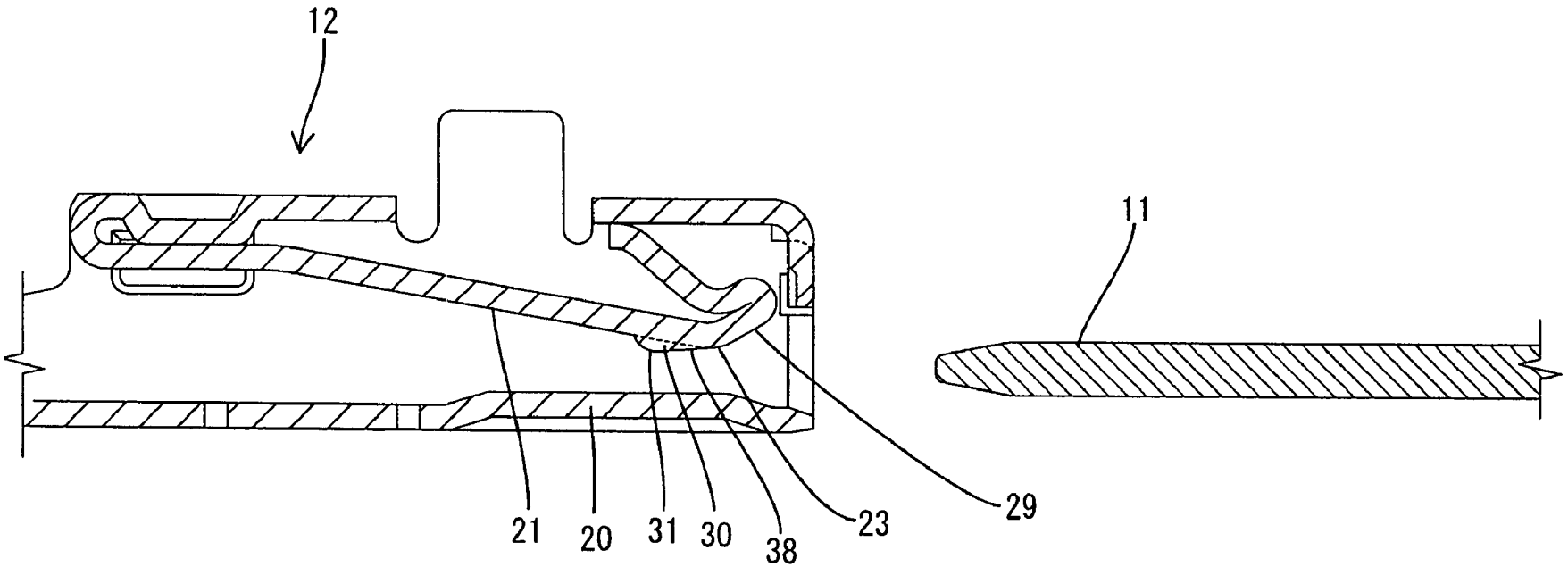
FIG. 5 is a sectional side elevation showing a state in which a tab has not been inserted into the female terminal fitting.

A flat and dome-shaped projection 30 bulges from a lower surface of the elastic beam 22 of the elastic contact piece 21 toward the protrusion 20 of the bottom wall 16. The projection 30 is formed by striking down the elastic beam 22. The projection 30, when viewed from below, extends longitudinally and has a generally elliptical shape that is gradually narrower towards the front, as shown in FIG. 2.

The projection 30 has an inclined surface 38 (see FIGS. 5 and 6) that inclines gently rearward from a front end thereof A contact 31 is formed at a rear side of the inclined surface 38 and is configured for contacting the tab 11. A region of the projection 30 rearward from the contact 31 inclines steeply toward the elastic body 22, and a rear end thereof is continuous with a lower surface of the elastic beam 22. The contact 31 is located about ⅔ of the whole length from a front end of the contact 30 to the rear end thereof.

A bulge start point 32 is formed at the front end of the inclined surface 38 substantially at the apex 23 and at the front of the projection 30. Therefore the projection 30 is midway in a region where the interval between the elastic beam 22 and the bottom wall 16 increases. The contact 31 of the projection 30 is slightly lower than the apex 23 in a vertical direction, and hence in a direction orthogonal to the axis of the female terminal fitting 10. The interval between the contact 31 and the protrusion 20 opposed thereto is smaller than the thickness of the tab 11, but to an extent so that an operator does not feel excessive resistance while inserting the tab 11 into the body 12.

Figure 6:
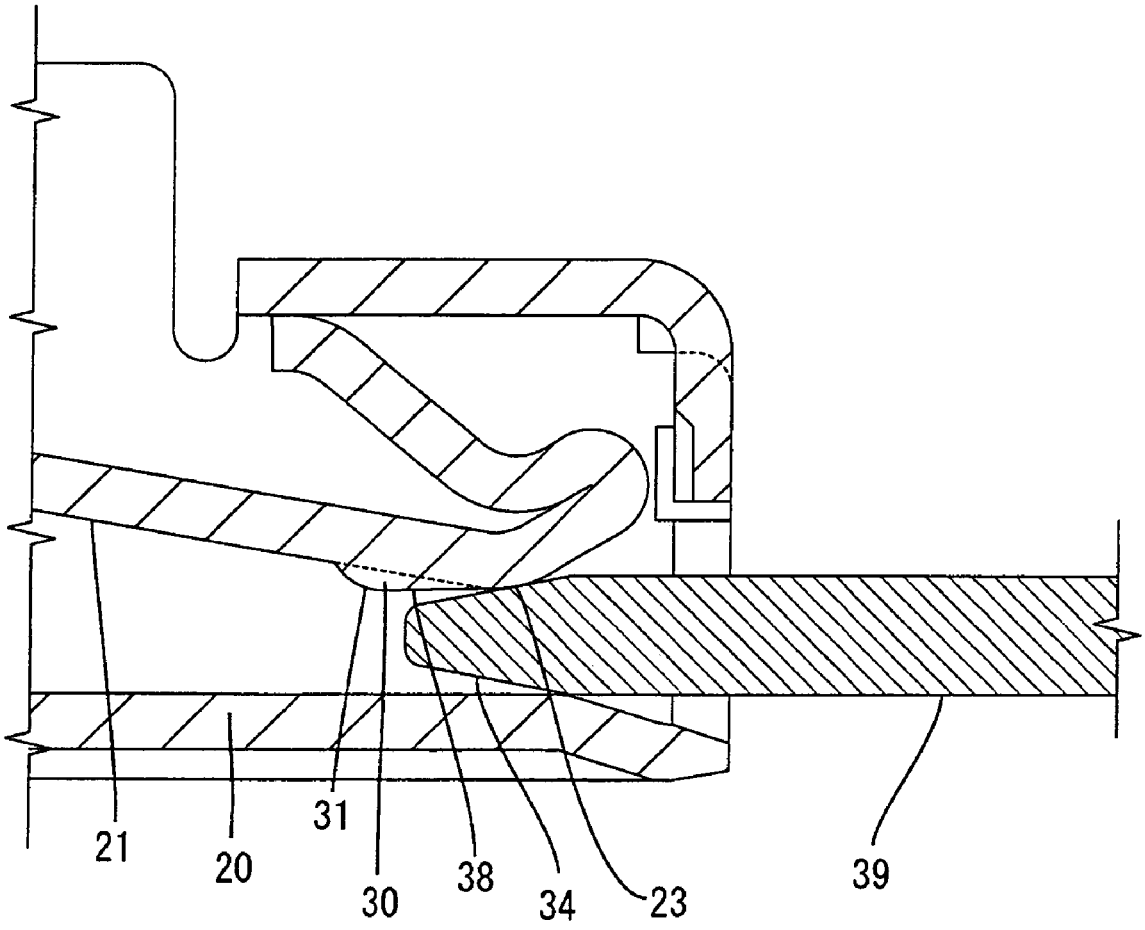
FIG. 6 is a main portions-enlarged sectional side elevation showing a state in which a tab starts to contact an elastic contact piece.

The tab 11 initially is inserted into the body 12 from the front of the female terminal fitting 10 through the insertion opening 15. As a result, as shown in FIG. 6, a forward taper 34 of the tab 11 contacts the guide surface 29 of the elastic contact piece 21. Consequently the elastic contact piece 21 deforms flexibly about the proximal portion 27 of the elastic beam 22, and the rear end of the sliding-contact portion 25 slides rearward along the inner surface of the ceiling wall 17.

Figure 7:
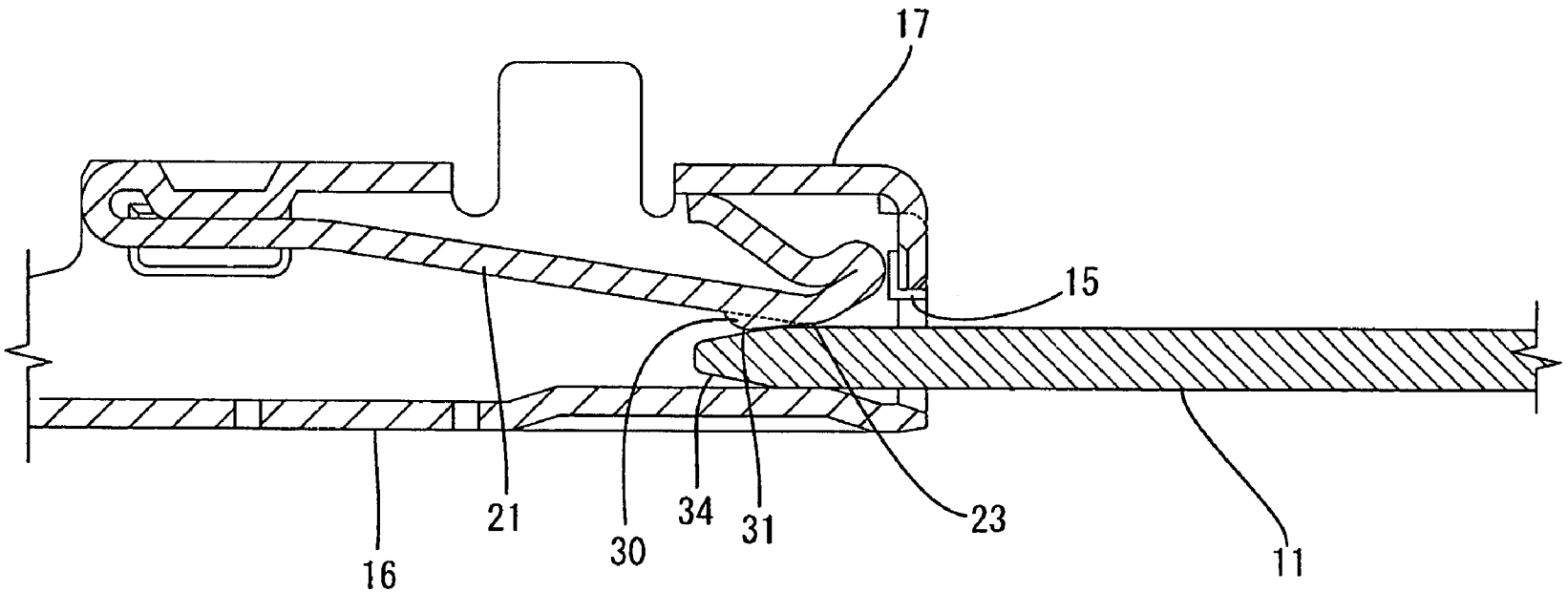
FIG. 7 is a main portions-enlarged sectional side elevation showing a state in which the tab starts to perform an operation of sliding contact between the tab and a sloped portion of a contact projection.

The taper 34 of the tab 11 slides smoothly rearward on the guide 29 of the elastic contact piece 21, and hence the elastic contact piece 21 is pressed up. As shown in FIG. 7, the taper 34 of the tab 11 eventually passes the apex 23 and reaches a position corresponding to the projection 30. Thus, the taper 34 of the tab 11 strikes the inclined surface 38 of the projection 30 in a face contact. Further insertion of the tab 11 into the body 12 causes the taper 34 of the tab 11 to move to the contact 31 along the inclined surface 38 of the projection 30.

Figure 8:
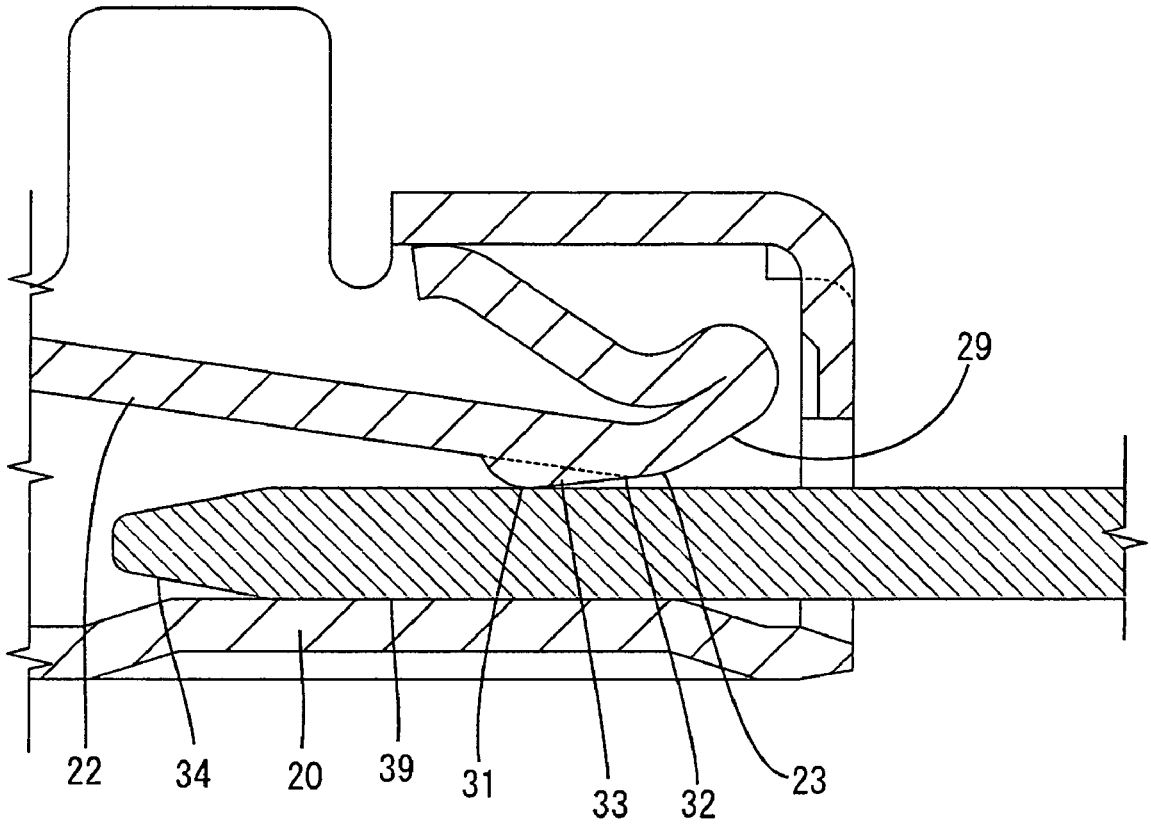
FIG. 8 is a main portions-enlarged sectional side elevation showing a state in which the tab is normally inserted into a body part of the female terminal fitting.
Figure 9:
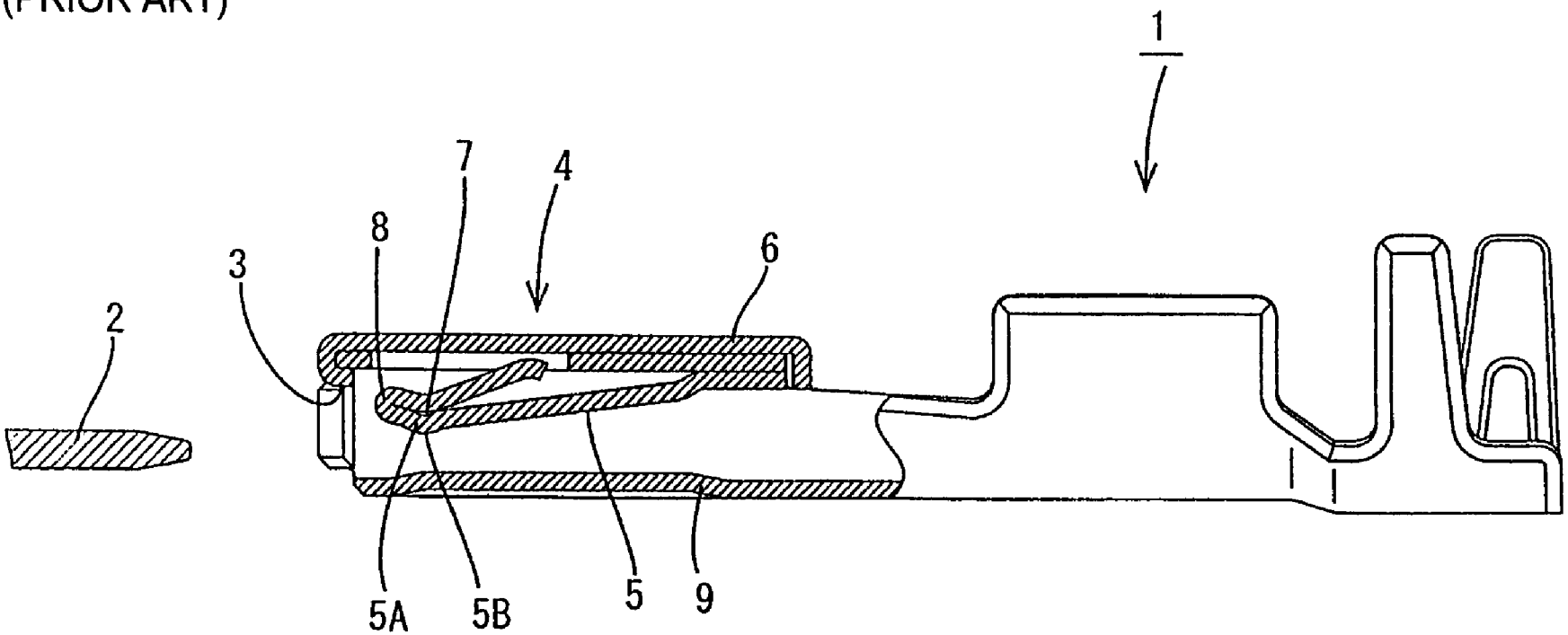
FIG. 9 (PRIOR ART)
FIG. 9 is a side view showing a conventional example of a female terminal fitting in which main portions are broken away.

The gap between the contact 31 of the elastic contact piece 21 and the protrusion 20 increases as the tab 11 is inserted. However, the amount of flexible displacement of the elastic contact piece 21 is small because the gap is set widely. A planar peripheral surface 39 of the tab 11 rearward of the taper 34 slidably contacts the contact 31 after the taper 34 of the tab 11 rides across the inclined surface 38 and passes the contact 31. In this manner, as shown in FIG. 8, the tab 11 reaches the normal insertion position. Thus, the tab 11 is connected electrically with the female terminal fitting 10, and is sandwiched between the contact 31 of the elastic contact piece 21 and the protrusion 20.

The contact 31 of the projection 30 is rearward from the apex 23. Thus, the tab 11 passes the apex 23 and starts to engage the contact 31, while increasing the gap between the elastic contact piece 21 and the bottom wall 16. Movement of the tab 11 to and beyond the contact 31 does not cause a rapid increase of the force for inserting the tab 11 into the body 12 because the amount of flexible displacement of the elastic contact piece 21 is small. Consequently, an operator can connect the male and female housings easily. Further the contact 31 of the contact 30 is between the apex 23 and the proximal portion 27 about which the elastic contact piece 21 flexes. Therefore, a stable contact pressure of elastic contact piece 21 against tab 11 is achieved after the tab 11 is inserted into the body 12.

The bulge start point 32 of the projection 30 is coincident with the apex 23 in the axial direction of the female terminal fitting 11. Therefore, the gap between the contact 31 and the protrusion 20 becomes large when the tab 11 is inserted into the body part 12 and the resistance to the insertion of the tab 11 into the body 12 is reduced significantly. Further, the contact 31 of the projection 30 is slightly lower than the apex 23. Thus, the flexible displacement amount of the elastic contact piece 21 is reduced, and resistance to the insertion of the tab 11 into the body 12 is decreased significantly.

Further, the taper 34 of the tab 11 and the guide surface 29 of the elastic contact piece 21 slidably contact each other at the start time of the insertion of the tab 11 into the body 12. Thus the elastic contact piece 21 flexes smoothly.

Further the operation of sliding between the taper 34 of the tab 11 and the inclined surface 38 of the projection 30 starts with the taper 34 and the inclined surface 38 in the face contact. Thus, the elastic contact piece 21 flexes smoothly.

The invention is not limited to the above-described embodiment described above with reference to the drawings. For example, the following embodiments are included in the technical scope of the present invention. Further, various modifications of the above-described embodiment can be made without departing from the spirit and scope of the present invention.

In the above-described embodiment, the proximal portion of the elastic contact piece is connected with the ceiling wall. However, the elastic contact piece may be separate from the body and the proximal portion thereof may be connected with a mounting portion of the ceiling wall by press fit or the like.

In the above-described embodiment, the proximal portion of the elastic contact piece is connected with the ceiling wall. But in the present invention, the proximal portion of the elastic contact piece may be connected with the bottom wall.

In the above-described embodiment, the bulge start point of the projection is coincident with the apex in the longitudinal direction of the female terminal fitting. However, the bulge start point of the projection may be rearward from the apex to reduce the resistance to the insertion of the tab into the body.

In the above-described embodiment, the bulge start point of the projection is slightly lower than the apex in the vertical direction. However, the bulge start point of the projection may be coincident with the apex or to the side of the proximal portion with respect to the apex in the vertical direction. Thus, the gap between the contact portion and the protrusion is large. Therefore, it is possible to reduce the resistance to the insertion of the tab into the body and to secure a stable contact pressure after the tab is inserted into the body part.

What is claimed is:

1. A female terminal fitting comprising:

a substantially rectangular tubular body with opposite front and rear ends, opposed first and second walls extending from the front end towards the rear end and an insertion opening at the front end for receiving a tab of a mating male terminal fitting between the first and second walls;

a support unitary with the second wall;

an elastic contact piece disposed inside said body and having an elastic beam extending obliquely forward from the support on said second wall towards both said insertion opening and said first wall, an apex at a front end of the elastic beam, a tapered guide extending obliquely from said apex and towards said second wall and said front end, a folded portion extending from the tapered guide back towards said rear end and a sliding contact portion extending from the folded portion obliquely towards the rear end and the second wall; and a projection formed on said elastic beam and bulging towards said first wall to define a contact spaced from the first wall by a distance that is not greater than a distance between the apex and the first wall, the projection being disposed so that said apex is between the projection and the front end of the body, whereby said elastic contact piece deforms flexibly about said support when said tab is inserted into said insertion opening of said body.

2. The female terminal fitting of claim 1, wherein said projection has an inclined portion inclining from said contact to a bulge start point substantially at said apex.

3. The female terminal fitting of claim 1, wherein said projection has an inclined portion inclining from said contact to a bulge start point between said apex and said support.

4. The female terminal fitting of claim 1, wherein the distance from the contact to the first wall is less than the distance from the apex to the first wall.

5. The female terminal fitting of claim 1, wherein the elastic contact piece has opposite side edges, the projection being spaced inward from the side edges.

6. The female terminal fitting of claim 5, wherein the projection is substantially elliptical.

7. The female terminal fitting of claim 6, the projection has a maximum width closer to a rear end of the projection than to a front end thereof.

8. The female terminal fitting of claim 7, wherein the contact is at the location on the projection defining the maximum width.

* * * * *